United States Patent [19]

Schleicher et al.

[11] Patent Number: 4,700,870

[45] Date of Patent: Oct. 20, 1987

[54] MOVABLE FLUID DISPENSER WITH AIR BUBBLE DETECTORS FOR CONTROLLING DISPENSER MOVEMENT

[75] Inventors: John K. Schleicher, Borden; James R. James, Sr., Clarksville, both of Ind.

[73] Assignee: Accuratio Systems, Inc., Jeffersonville, Ind.

[21] Appl. No.: 830,195

[22] Filed: Feb. 18, 1986

[51] Int. Cl.[4] ..... B67D 5/34; B67D 5/06

[52] U.S. Cl. ..... 222/63; 222/638; 137/173; 118/688

[58] Field of Search ..... 222/52, 61, 638, 72, 222/63; 356/410; 250/573; 604/65, 67, 253; 128/DIG. 13, DIG. 12; 137/173, 174, 177, 183; 340/603, 627, 632, 609; 209/657; 118/688

[56] References Cited

U.S. PATENT DOCUMENTS 3,252,441 5/1966 Hargreaves ..... 222/52 X
3,283,899 11/1966 Vedvik et al. ..... 209/567 X
3,639,728 2/1972 Helfand et al. ..... 209/657 X
3,648,694 3/1972 Mogos et al. ..... 222/61 X
4,312,341 1/1982 Zissimopoulos et al. ..... 356/410 X

*Primary Examiner*—H. Grant Skaggs
*Assistant Examiner*—Edward S. Ammeen
*Attorney, Agent, or Firm*—Jon C. Winger

[57] ABSTRACT

An apparatus for dispending a fluid free of included air bubbles, such as for example, an adhesive bead, includes sensing devices for detecting the presence of an included air bubble in the conduit leading from a source of the fluid to a discharge of a movable fluid dispenser. The sensing devices are connected to a motor which drives an arm on which the fluid dispenser is mounted. A first sensing device slows movement of the dispenser upon sensing an air bubble in the fluid and a second sensing device stops movement of the dispenser upon sensing an air bubble in the fluid. The movement of the dispenser is restarted after a predetermined time period sufficient to allow the air bubble to pass out of the dispenser discharge. The sensing devices advantageously use a light beam, such as infra-red light or laser, to detect the presence of the included air bubble.

3 Claims, 7 Drawing Figures

MOVABLE FLUID DISPENSER WITH AIR BUBBLE DETECTORS FOR CONTROLLING DISPENSER MOVEMENT

BACKGROUND OF THE INVENTION

1. Field of the Invention

The present invention is related to the field of detectors and detecting by light, and more particularly to apparatus for dispensing a fluid including gas infusion detecting means and means for the elimination of the gas.

2. Discussion of the Prior Art

As presently contemplated, the present invention has an immediate practical use in applying a bead of adhesive to a workpiece. However, it should be made eminently clear at the point that the present invention is not limited to applying an adhesive bead to a workpiece.

In enumerable situations, the presence of a gas bubble in a liquid has drawbacks.

In the medical field, for example, a hazard associated with the infusion of liquids into a patient is the presence of gas, such as air bubbles, in the liquid.

In manufacturing, it has now become a common practice to attach to components of a product together with an adhesive material instead of welding. The presence of a gas bubble, for example, air in the applied adhesive results in a location of a weak bond between the workpiece components.

SUMMARY OF THE INVENTION

It is an object of the present invention to provide an apparatus for dispensing a fluid which provides not only for the detection of a gas bubble in a fluid, but also for the elimination of the gas bubble without interruption to the dispensing of liquid free of included gas bubbles.

It is another object of the present invention to provide an apparatus for dispensing a fluid which provides for the detection of a gas bubble in the fluid being dispensed and elimination of the gas bubble and, therefore, the potentially adverse void created by the gas bubble in the dispensed fluid.

It is yet another object of the present invention to provide an apparatus for dispensing a fluid of the class described wherein the gas bubble is detected using light.

The present invention, in one advantageous embodiment, provides an apparatus for dispensing a fluid comprising a source of the fluid, conduit means through which the fluid is transferred from the fluid source, means for moving the fluid from the source through the conduit means, means for sensing the presence of a gas bubble included in the fluid moving through the conduit means and means responsive to the sensing means for bleeding the gas bubble from the fluid moving through the conduit means.

The present invention, in another advantageous embodiment, provides an apparatus for dispensing a fluid comprising a source of fluid, conduit means through which the fluid is transferred from the liquid source, means for moving the fluid from the fluid source through the conduit means, means for sensing the presence of a gas bubble included in the fluid moving through the conduit means, and means responsive to the sensing means for bleeding the gas bubble from the fluid moving through the conduit means without interruption to the flow of fluid not having an included gas bubble.

BRIEF DESCRIPTION OF THE DRAWINGS

The advantages and objectives of the present invention will become even more clear upon reference to the following description in conjunction with the accompanying drawings in which like numerals refer to like parts throughout and wherein.

DETAILED DESCRIPTION OF THE PREFERRED EMBODIMENTS

Figure 1:
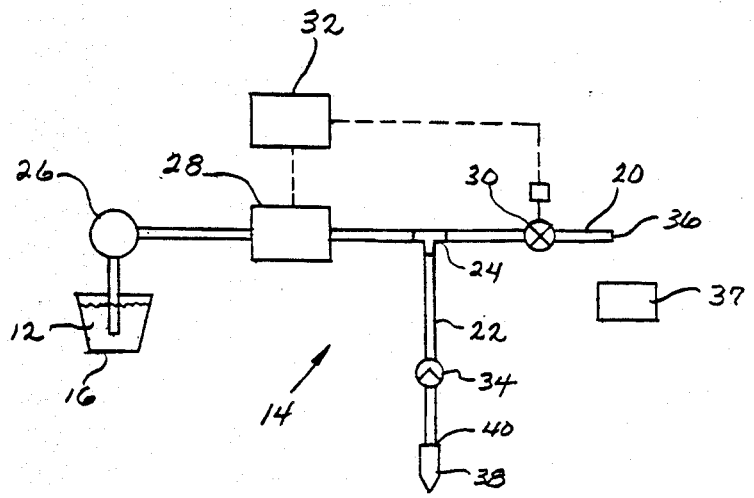
FIG. 1 is a schematic representation of one embodiment of the apparatus of the present invention for dispensing a fluid.

With reference to FIG. 1, there is shown an apparatus, generally denoted as the numeral 10, of the present invention for dispensing a fluid 12. As shown, the apparatus 10 includes conduit means, generally denoted as the numeral 14, in flow communication with a source 16 of fluid 12.

The conduit means 14 is shown as having a fluid inlet branch 18, a fluid bleed branch 20 in flow communication with the inlet branch 18, and a fluid dispensing branch 22 in flow communication with the inlet branch 18. The inlet, bleed and dispensing branches are shown as intersecting at a T-fitting 24. The inlet branch 18 is connected to a fluid pump 26 located at the fluid source 16 for moving the fluid 12 from the source 16 through the conduit means 14.

The apparatus 10 includes gas bubble sensing means, generally denoted as the numeral 28, for sensing the presence of a gas bubble included in the fluid moving through the conduit means 14. The gas bubble sensing means 28 is located in the fluid inlet branch 18 of the conduit means 14 for sensing an included gas bubble before the gas bubble would reach the fluid dispensing branch 22 and the fluid bleed branch 20 of the conduit means 14.

Bleed valve means denoted as the numeral 30 is located in the fluid bleed branch 20 for opening and closing the fluid bleed branch 20. The bleed valve means 30 is operatively associated with the gas bubble sensing means 28 so that the bleed valve means 30 will open and close in response to the sensing or detection of an included gas bubble by the sensing means 28. When the sensing means 28 detects an included gas bubble in the fluid flowing in the fluid inlet branch 18 of the conduit means 14, it causes the bleed valve means 30 to open allowing the portion of the fluid having the included gas bubble to flow through the fluid bleed branch 20 of the conduit means 14 bypassing the fluid dispensing branch 22. After the included gas bubble has passed the bleed valve means 30, the bleed valve means 30 is closed so that fluid not having an included gas bubble will flow to the fluid dispensing branch 22 of the conduit means 14. Toward this objective, timer means 32 is associated with the bleed valve means 30 and the gas bubble sensing means 28. The timer means 32 closes the bleed valve means 30 after a predetermined time measured from the time the sensing means 28 opens the bleed valve means 30 sufficient to allow the included gas bubble detected by the sensing means 28 to pass the open bleed valve means 30 so that fluid not having an included gas bubble will move through the fluid dispensing branch 22.

In addition, as shown, the apparatus 10 has a fluid check valve means 34 located in the fluid dispensing branch 22 of the conduit means 14. The check valve means 34 prevents the back flow of pressurized fluid already in the dispensing branch 22 into the bleed branch 20 when the bleed valve means 30 is open.

The bleed branch 20 is open at a discharge end 36 downstream of the bleed valve means 30 to a reservoir 37 for waste fluid which had included gas bubbles bleed from the apparatus 10.

The fluid dispensing branch 22 has, for example, a dispensing nozzle device 38 at its discharge end 40 for controlling the discharge of the fluid.

Figure 2:
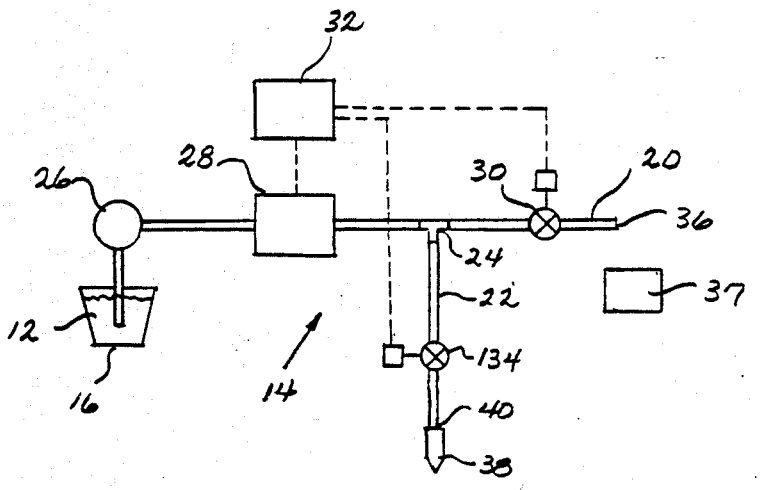
FIG. 2 is a schematic representation of another embodiment of the apparatus of the present invention for dispensing a fluid.

With reference to FIG. 2, there is shown an apparatus, generally denoted as the numeral 110, which is a somewhat modified version of the apparatus 10 of FIG. 1. Therefore, the components in common between the apparatus 10 and 110 are denoted by the same numerals and the description therof will not be repeated for the sake of brevity. The main difference between the apparatus 10 and 110 is that the check valve 34 has been replaced by a shut-off valve 134 operatively associated with the sensing means 28 to open and close in response to the detection of an included gas bubble detected by the gas bubble sensing means 28. Toward this end, the shut-off valve 134 is also interconnected with the timer means 32. In operation, when the sensing means 28 causes the bleed valve means 30 to open, it also causes the shut-off valve 134 to close thus preventing the flow of fluid into the fluid dispensing branch 22 of the conduit means 14. After the predetermined time has elapsed, the timer means 32 closes the bleed valve means 30 and concurrently opens the shut-off valve 134 to allow the flow of fluid through the fluid dispensing branch 22.

It is contemplated that the bleed valve means 30 and shut-off valve means 134 can be replaced by an equivalent three-way valve means located at the intersection of the intersection of the inlet branch 18, fluid bleed branch 20 and dispensing branch 22 at the location of the T-fitting 24. The three-way valve means would also be operatively associated with the timer means 32 to open and close the bleed branch 20 and dispensing branch 22 as described in relationship to the bleed valve means 30 and shut-off valve means 134 as discussed above.

Figure 3:
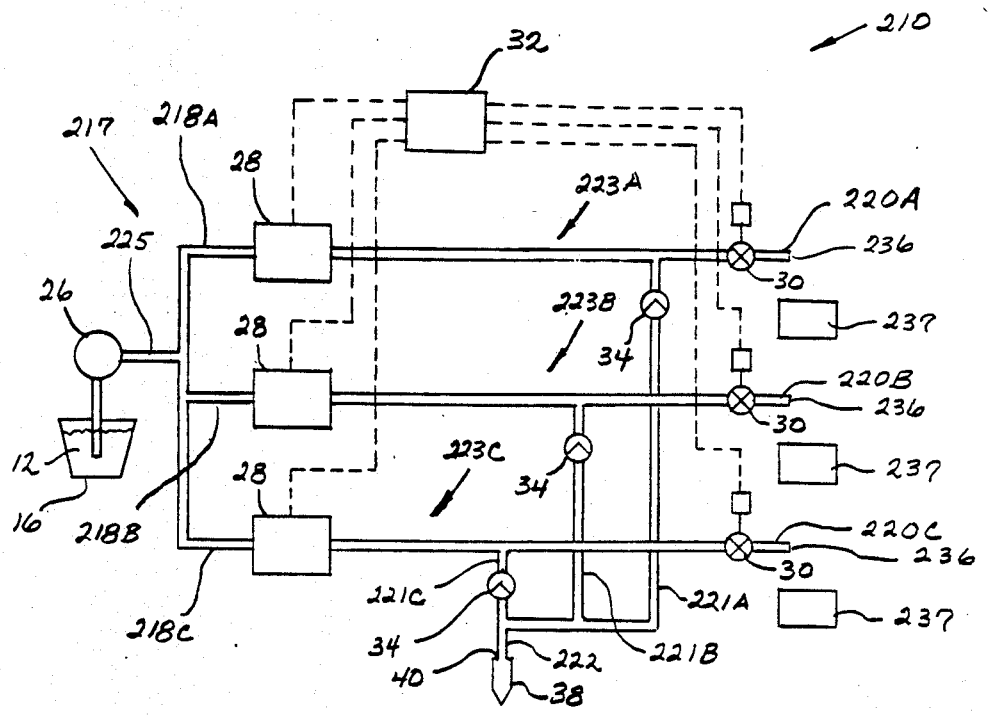
FIG. 3 is a schematic representation of yet another embodiment of the apparatus of the present invention.

With reference to FIG. 3, there is shown an apparatus, generally denoted as the numeral 210, of the present invention for dispensing a fluid 12 which includes the same principles as the apparatus 10 of FIG. 1.

The apparatus 210 includes conduit means 214 in flow communication with the source 16 of the fluid 12. The conduit means 214 comprises a manifold system, generally denoted as the numeral 217, having a plurality of fluid inlet branches 218A, 218B, 218C, fluid bleed branches 220A, 220B, 220C, and fluid discharge branches 221A, 221B, 221C. Each fluid discharge branch 221 is in flow communication with a different one of the fluid inlet branches 218, and each one of the fluid bleed conduits 220 is in fluid flow communication with a different one of the fluid inlet branches 218, and each one of the fluid bleed conduits 220 is in fluid flow communication with a different one of the fluid inlet branches 218. For example, the manifold system 217 comprises three stems 223A, 223B, and 223C. The first stem 223A comprises the fluid inlet branch 218A, the fluid bleed branch 220A, and the fluid discharge branch 221A in mutual flow communication; the second stem 223B comprises the fluid inlet branch 218B, the fluid bleed branch 220B and the fluid discharge branch 221B in mutual flow communication; and the third stem 223C comprises the fluid inlet branch 218C, the fluid bleed branch 220C, and the fluid discharge branch 221C in mutual flow communication. The inlet, bleed and discharge branches of each manifold stem 223A, 223B and 223C intersect at a T-fitting. The fluid inlet branches 218A, 218B and 218C are interconnected through a common fluid feed branch 225 to fluid pump 26 located at the fluid source 16 for moving the fluid 12 from the source 16 through the conduit means 214, and the manifold stems 223A, 223B and 223C are disposed in parallel fluid flow relationship. Therefore, fluid 12 is concurrently moved through all of the manifold stems 223A, 223B and 223C. The fluid discharge branches 221A, 221B and 221C are interconnected to a common fluid dispensing branch 222 which will dispense fluid flowing through any one, or any combination of the manifold stems 223A, 223B and 223C.

Each of the manifold stems 223A, 223B and 223C includes gas bubble sensing means 28 for sensing the presence of a gas bubble included in the fluid moving through each manifold stem 223A, 223B and 223C. Preferably, there is sensing means 28 disposed in each one of the fluid inlet branches 218A, 218B and 218C for sensing an included gas bubble before the gas bubble would reach the fluid dispensing branch 222, and more particularly, before it would reach the fluid discharge branches 221A, 221B and 221C of the conduit means 214.

Bleed valve means 30 is located in each of the fluid bleed branches 220A, 220B, 220C for independently opening and closing the fluid bleed branches 220A, 220B, 220C. Each bleed valve means 30 is operatively associated with the gas bubble sensing means 28 which is located in the same manifold stem 223 so that the bleed valve means 30 will open and close in response to the sensing or detection of an included gas bubble by the sensing means 28. When a sensing means 28 detects an included gas bubble in the fluid flowing in the fluid inlet branch 218, it causes the bleed valve means 30 to open allowing the portion of the fluid having the included gas bubble to flow through the fluid bleed branch 220 by-passing the fluid dispensing branch 222. After the included gas bubble has passed the bleed valve means 30, the bleeed valve means 30 is closed so that fluid not having an included gas bubble will flow through the fluid branch 221 to the dispensing branch 222. Toward this objective, timer means 32 is associated with each bleed valve means 30 and each bubble sensing means 28. The timer means 32 closes the bleed valve means 30 after a predetermined time measured from the time the sensing means 28 opens the bleed valve means 30 sufficient to allow the included gas bubble detected by the sensing means 28 to pass the open bleed valve means 30 so that fluid not having an included gas bubble will move through the fluid dispensing branch 222.

In addition, as shown, the apparatus 210 has fluid check valve means 34 located in each of the fluid discharge branches 221A, 221B, 221C of each manifold stem 223A, 223B, 223C. The check valve means 34 prevents the back flow of pressurized fluid already in the fluid discharge branch 221 into the bleed branch 220 when the bleed valve means 30 is open.

Each bleed branch 220A, 220B, 220C is open at a discharge end 236 downstream of the bleed valve means 30 to a reservoir 237 for waste fluid which had included gas bubbles bleed from the apparatus 210.

The fluid dispensing branch 222 has, for example, a dispensing nozzle device 38 at its discharge end 40 for controlling the discharge of the fluid.

In operation of the apparatus 210, when included gas bubbles are detected in the fluid flowing in any of the manifold stems 223A, 223B, 223C, the sensing means 28 in that manifold stem will cause the bleed valve means 30 in that manifold stem to open to bleed the gas bubble from the system through the bleed branch 220A, 220B, 220C of that manifold stem thus preventing the fluid having the included gas bubble from flowing through the fluid discharge branch 221A, 221B, 221C in that manifold stem to the common fluid dispensing branch 222. However, fluid not having an included gas bubble flowing in the other manifold stems 223A, 223B, 223C will continue to flow to the common fluid dispensing branch 222 so that there is no interruption to the flow of fluid through the apparatus 210 to be dispensed.

Figure 4:
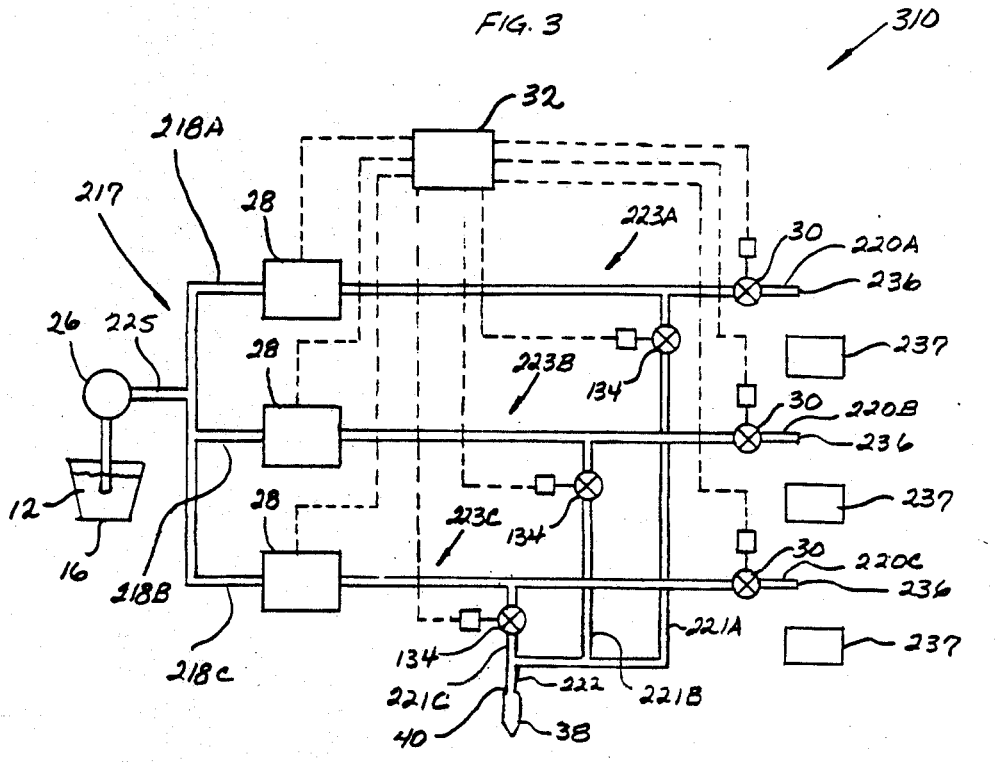
FIG. 4 is a schematic representation of still another embodiment of the apparatus of the present invention.

With reference to FIG. 4, there is shown an apparatus 310 which is a somewhat modified version of the apparatus 210 of FIG. 3. Therefore, the components in common between apparatus 210 and 310 are denoted by the same numerals and the description thereof will not be repeated for the sake of brevity. The main difference between the apparatus 210 and 310 is that the check valve means 34 in each of the fluid discharge branches 221A, 221B, 221C have been replaced by a shut-off valve 134 operatively associated with the sensing means 28 to open and close in response to the detection of an included gas bubble detected by the gas bubble sensing means 28 located in the same manifold stem 223A, 223B, 223C. Toward this end, the shut-off valve 334 is also interconnected with the timer means 32. In operation, when the sensing means 28 causes the bleed valve means 30 to open, it also causes the shut-off valve 334 in the same manifold stem 223A, 223B, 223C to close, thus preventing the flow of fluid through the fluid discharge branch 221A, 221B, 221C and into the fluid dispensing branch 222 of the conduit means 214. After the predetermined time has elapsed, the timer means 32 closes the bleed valve means 30 and concurrently opens the shut-off valve 334 to allow the flow of fluid to the fluid discharge branch 221A, 221B, 221C to the common fluid dispensing branch 222.

It is contemplated that the bleed valve means 30 and shut-off valve means 134 in each manifold stem 223A, 223B and 223C be replaced by an equivalent three-way valve means located at the intersection of the fluid inlet branch 218, fluid bleed branch 220 and fluid discharge branch 221 of the manifold stem 223. The three-way valve means would also be operatively associated with the timer means 32 to open and close the bleed branch 220 and discharge branch 221 as described in relationship to the bleed valve means 30 and shut-off valve means 134 as discussed above.

Figure 5:
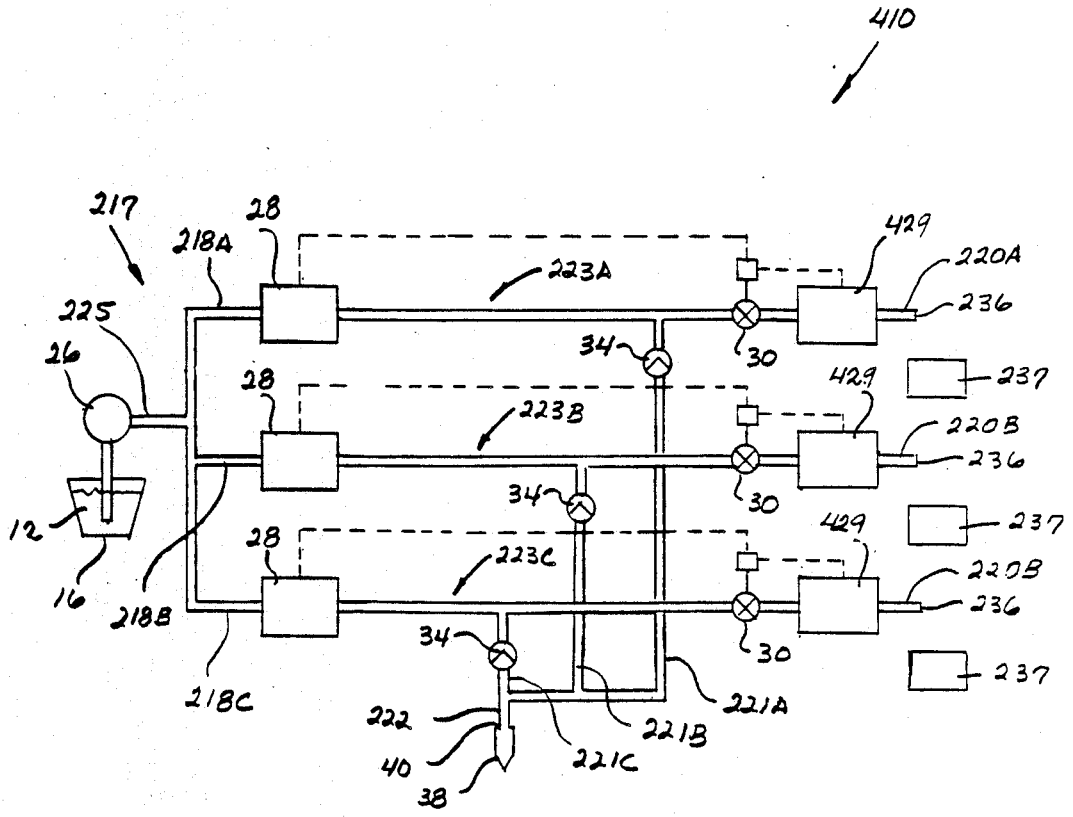
FIG. 5 is a schematic representation of a further embodiment of the apparatus of the present invention.

FIG. 5 illustrates an apparatus generally denoted as the numeral 410 which has many features and components in common with the apparatus 210 of FIG. 3 and apparatus 310 of FIG. 4. The common features and components are denoted by identical numerals and the description thereof will not be repeated for the sake of brevity.

The main difference between the apparatus 410 and the apparatus 210 and 310 is that the timer means 32 is eliminated. In place of the timer means 32 for closing the bleed valve means 30, the apparatus 410 uses second gas bubble sensing means 429 located in each fluid bleed branch 220A, 220B, 220C. Each second gas bubble sensing means 429 is positioned downstream of the bleed valve means 30 and is operatively connected to the bleed valve means 30 in the same fluid bleed branch 220A, 220B, 220C.

In operation, when the first gas bubble sensing means 28 detects an included gas bubble in the fluid flowing through the fluid inlet branch 218A, 218B, 218C it causes the bleed valve means 30 in the same manifold stem 223A, 223B, 223C to open, as discussed in regard to the embodiments of FIGS. 3 and 4, to bleed the portion of the fluid having the included gas bubble through the fluid bleed branch 220A, 220B, 220C. The second gas bubble sensing means 429 detects the passing of the included gas bubble, and after it has passed the second gas bubble sensing means 429, the second gas bubble sensing means 429 causes the bleed valve means 30 to close. If the shut-off valve means 134 of the apparatus 310 is also included in the apparatus 410 instead of check valve means 34, the second bubble sensing means 429 is also operatively associated with the shut-off valve means 134 so that after the included gas bubble has passed the second gas bubble sensing means 429, it also causes the shut-off valve means 134 to open.

Figure 6:
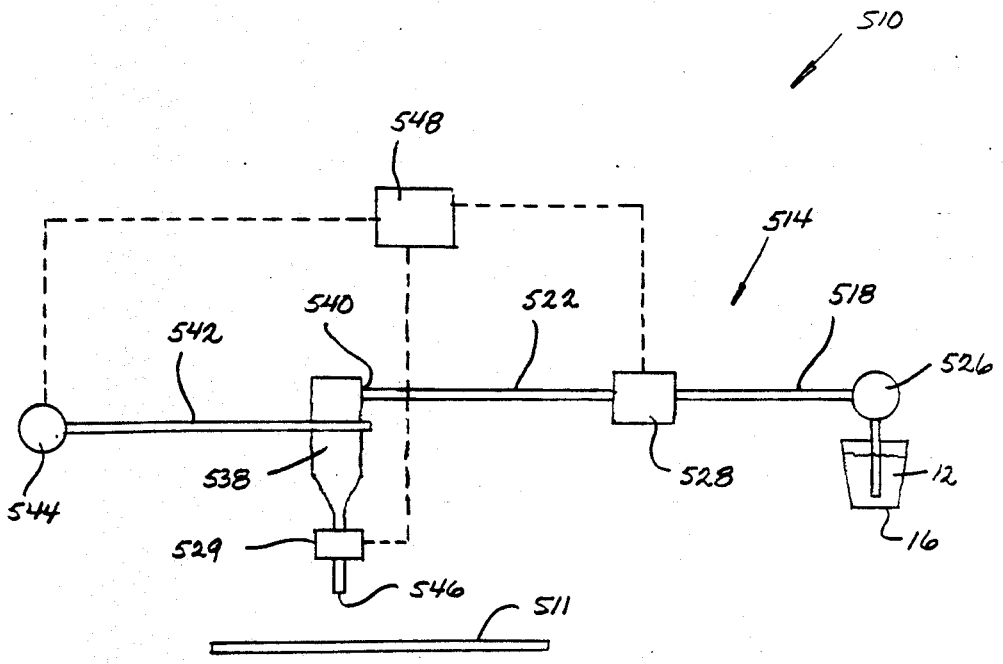
FIG. 6 is a schematic representation of yet a further embodiment of the apparatus of the present invention.

FIG. 6 illustrates an apparatus, generally denoted as the numeral 510, for dispensing fluid to a workpiece 511. The apparatus 510 includes conduit means, generally denoted as the numeral 514, in flow communication with a source 16 of fluid 12.

The conduit means 514 is shown as having a fluid inlet branch 518 and a fluid dispensing branch 522. The fluid inlet branch 518 is connected to a fluid pump 526 located at the fluid source 16 for moving the fluid 12 from the source 16 through the conduit means 514.

A fluid dispensing nozzle device 538 is located at the discharge end 540 of the fluid dispensing branch 522 for controlling the dispensing of the fluid on the workpiece 511. The fluid dispensing nozzle device 538 is mounted for movement along a predetermined path over the workpiece 511. Therefore, the fluid dispensing branch 522 should be relatively long and of flexible construction. The dispensing nozzle device 538 can be mounted to a movable manipulating arm 542 and the manipulating arm 542 is driven along the predetermined path by, for example, electric motor 544. The movable manipulating arm 542 and drive motor 544 arrangements are known in the art and will, therefore, not be further discussed here.

It is an objective of the apparatus 510 to stop movement of the movable arm 542 when there is an included gas bubble in the fluid being dispensed to prevent a void in the fluid dispensed on the workpiece 511. However, it has been determined that due to the momentum of typical moving arms 542 that it is virtually impossible to immediately stop the arm 542. Toward this objective and to overcome this problem, the apparatus 510 includes first bubble sensing means 528 located in the fluid dispensing branch 522 upstream of the dispensing nozzle device 538 and second bubble sensing means 529 located immediately upstream of the discharge 546 of the nozzle device 538. Both first and second gas bubble sensing means 528 and 529 are operatively associated through appropriate controls 548 to the electric motor 544 driving the movable arm 542. When the first bubble sensing means 528 detects an included gas bubble in the fluid moving in the dispensing branch 522 to the nozzle device 538 it causes the electric drive motor 544 to slow, thus, slowing the movement of the arm 542. The included gas bubble initially detected by the first bubble sensing means 528 continues to move with the fluid through the nozzle device 538 to the nozzle discharge 546 whereat the second bubble sensing means 529 detects the included gas bubble and causes the motor 544 to stop, thus, stopping movement of the arm 542. The motor control 548 also includes timer means for restarting the electric motor 544 driving the arm 542 after a predetermined length of time sufficient to allow the included gas bubble to pass through the nozzle discharge 546 so that when the arm 542 resumes movement fluid free of included gas bubbles is being dispensed to the workpiece, thereby preventing voids in the fluid dispensed to the workpiece.

With reference to the above discussed apparatus, the bleed valve means 30 and shut-off valve means 134 can be solenoid activated valves. Also, the timer means 32 would also include an amplifier to amplify the signal from the gas bubble sensing means 28.

Figure 7:
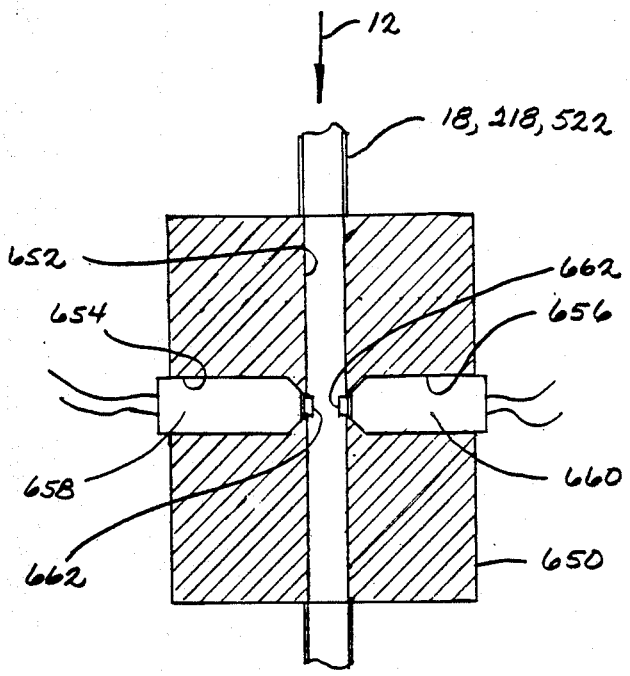
FIG. 7 is a cross-sectional view of a gas bubble sensing device which is a component of the apparatus of the present invention.

FIG. 7 illustrates an advantageous embodiment of a gas bubble sensor 28, 429, 528, 529 used in the above-described apparatus 10, 210, 310, 410 and 510 of the present invention. As shown, the gas bubble sensor includes a housing 650 formed with a flow-through passage 652 for fluid flow through the housing 650. The diameter of the passage 652 is smaller than the bore of the fluid conduits of the fluid conduit means of the above-described apparatus. A bore 654 is formed through the housing 650 open to one side of the passage 652 and another similar bore 656 is formed through the housing 650 open to the other side of the passage 652. The openings of the bores 654 and 656 are in alignment with each other across the diameter of the passage 652. A light source 658 is located in one of the bores, for example, bore 654, to direct light across the passage 652. A light sensor 660 is located in the other one of the bores, for example, bore 656, to receive the light eminating from the light source 658. The light source 658 may be of the type generating, for example, an ultra-violet light, infra-red light, or a laser generated light. The wave length of the light will depend to an extent on the type of fluid to be passed through the sensor device. The light transmission characteristics of the fluid flowing in the passage 652 will, of course, change as a gas bubble included in the fluid 12 passes between the light source 658 and light sensor 660. This change may be a change in the brightness of the light passing from the light source 658 to the light sensor 660. In some applications, the fluid is abrasive. In order to protect the light source 658 and light sensor 660 from the abrasive fluid, a lens 662 is placed over the opening of each bore 654 at the flow-through passage 652. It has been determined that a lens 662 made of sapphire works well.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. An apparatus for dispensing a fluid comprising:

a source of fluid;

conduit means in flow communication with the fluid soruce;

means for moving the fluid from the source through the conduit means;

dispensing means having a fluid discharge associated with the conduit means for controlling the dispensing of fluid from the conduit means;

means for moving the dispensing means along a predetermined path;

first means for sensing the presence of a gas bubble included in the fluid moving through the conduit means upstream of the dispensing means, the first sensing means being operatively associated with the dispensing means moving means for slowing the movement of the dispensing means when an included gas bubble is sensed by the first sensing means; and, second sensing means for sensing the presence of a gas bubble included in the fluid moving in the dispensing means upstream of the fluid discharge of the dispensing means, the second sensing means being operatively associated with the dispensing means moving means for stopping the movement of the dispensing means when an included gas bubble is sensed by the second sensing means.

2. The apparatus of claim 1, further comprising timer means operatively associated with the dispensing means moving means for restarting the dispensing means moving means after a predetermined time, measured from the time the second sensing means senses an included gas bubble, sufficient to allow the included gas bubble to pass out of the discharge of the dispensing means.

3. The apparatus of claim 1 wherein each of the first and second gas bubble sensing means comprises:

a light source disposed for directing a beam of light across the moving fluid; and, a light sensor disposed for receiving the beam of light from the light source across the moving fluid.

* * * * *